United States Patent [19]

Kinsey et al.

[11] Patent Number: 4,649,598

[45] Date of Patent: Mar. 17, 1987

[54] ENERGY SAVER SLIDING DOOR CLOSER INCLUDING A VALVED WEIGHT

[76] Inventors: Kenneth M. Kinsey, Rte. 1, Box 442, Henryetta, Okla. 74437; Tommy E. Talton, 1216 E. Smith, Okmulgee, Okla. 74447; Robert L. Lay, P.O. Box 130, Schulter, Okla. 74461

[21] Appl. No.: 796,995

[22] Filed: Nov. 12, 1985

[51] Int. Cl.[4] ..... E05F 1/00

[52] U.S. Cl. ..... 16/81; 16/84; 49/387

[58] Field of Search ..... 16/70, 72, 81, 84, DIG. 8; 49/387

[56] References Cited

U.S. PATENT DOCUMENTS 3,334,444 8/1967 Hargrove ..... 16/81 X
4,003,102 1/1977 Hawks et al. ..... 16/81 X
4,126,912 11/1978 Johnson ..... 16/81
4,357,732 11/1982 Hickman ..... 16/81

*Primary Examiner*—Fred Silverberg
*Attorney, Agent, or Firm*—Head Johnson Stevenson

[57] ABSTRACT

An energy saver door closer for use with a sliding door. A long cylindrical housing is attached to one vertical edge of the sliding door, a weight is in the cylinder and a cable connects the weight over a pulley in the top of the cylinder to an anchor in the door jam. A seal surrounds the weight so that there is a sealing contact with the housing to form a pneumatic cylinder therein. The lower part of the cylinder is provided with passageways which lets air go in or out. The upper part of the weight is provided with a valve which is always biased to the opened position but is held closed so long as the cable is taught. When the cable is loose, the valve opens and air can rush out and the door will close faster.

4 Claims, 13 Drawing Figures

ENERGY SAVER SLIDING DOOR CLOSER INCLUDING A VALVED WEIGHT

DISCLOSURE STATEMENT

A search revealed the following U.S. Pat. Nos.: 3,334,444; 4,003,102; 4,301,623; 4,126,912; 3,978,617; and 4,004,372.

Perhaps the most pertinent of these patents is U.S. Pat. No. 4,003,102 to Hawks et al entitled "Door and Window Closer". This patent describes a gravity motor having an override mechanism for removable window including a pneumatic cylinder, a piston, a check valve admitting air into the cylinder at the lower end, an override valve permitting pressure dumping of the air from the cylinder during movement of the door or window at a speed greater than the normal closing speed by the motor. The lower end of the housing or pneumatic cylinder has a check valve which admits air only inwardly and blocks the passage of air in the opposite direction. Normal escape of air is via shallow depressions 29, opening 17 in the valve plate 16 and passage 80 in the piston 7. This makes for a rather complicated valve mechanism in the upper end of the pneumatic cylinder.

BACKGROUND OF THE INVENTION

This invention relates to an "EZ Flow Energy Saver Door Closer" for use with sliding doors and windows.

A large percentage of the homes built within the last 20 years have sliding glass doors. The high cost of energy for heating and cooling has made it increasingly important to keep the doors closed most of the time. Children do not always remember to close the door when they enter or leave the room where the door is. Therefore, there is a need for having an automatic door closer.

Various spring and gravity motors have been suggested for automatically closing sliding doors immediately after they have been opened. One of these is U.S. Pat. No. 4,003,102 which provides a pneumatic motor for slowly closing a door but provides an override for those situations in which a person forced the door closed at a rate in excess of the normal closing rate of the motor.

SUMMARY OF THE INVENTION

This "EZ Flow Energy Saver Door Closer" TM provides a mechanism for closing sliding doors which provides the closing force and controls the rate of travel of the door toward its closed position. In a preferred embodiment, I provide an elongated housing which is a cylinder which is attached to the vertical edge of the door opposite the edge of the door on which the handle is positioned. A weight is provided and has a bore extending from the top. A lateral passage extends from the lower end of the bore to the exterior of the weight within the casing or the housing. A valve seat is provided in said bore above the air passage. A seal surrounds the upper end of the weight above the lateral passage and establishes an air chamber within the cylinder. A valve which when closed completely seals the upper end of the bore and is held there by the weight. The valve is connected to a cable which extends over a pulley on the upper end of the housing and extends to an anchor in the door jam. The valve is biased in an open position. When the valve is closed no air can escape upwardly through the valve seat or valve stem.

The lower end of the air chamber is provided with port or lower passage means which permit the passage of air in either direction. We also provide means in the lower passages to control the rate of flow therethrough by having a variable restriction. Thus, by merely changing the size of restriction of in-flow and out-flow of air, we can vary the speed at which the the door closes.

It is thus an object of this invention to provide an automatic door closer which is inexpensive and easy to install.

It is still a further object of this invention to provide a door closer in which the rate of closing can be varied as desired.

Various other objects and a better understanding of the invention can be had from the following description taken in conjunction with the drawings.

DETAILED DESCRIPTION OF THE PREFERRED EMBODIMENT

Figure 1:
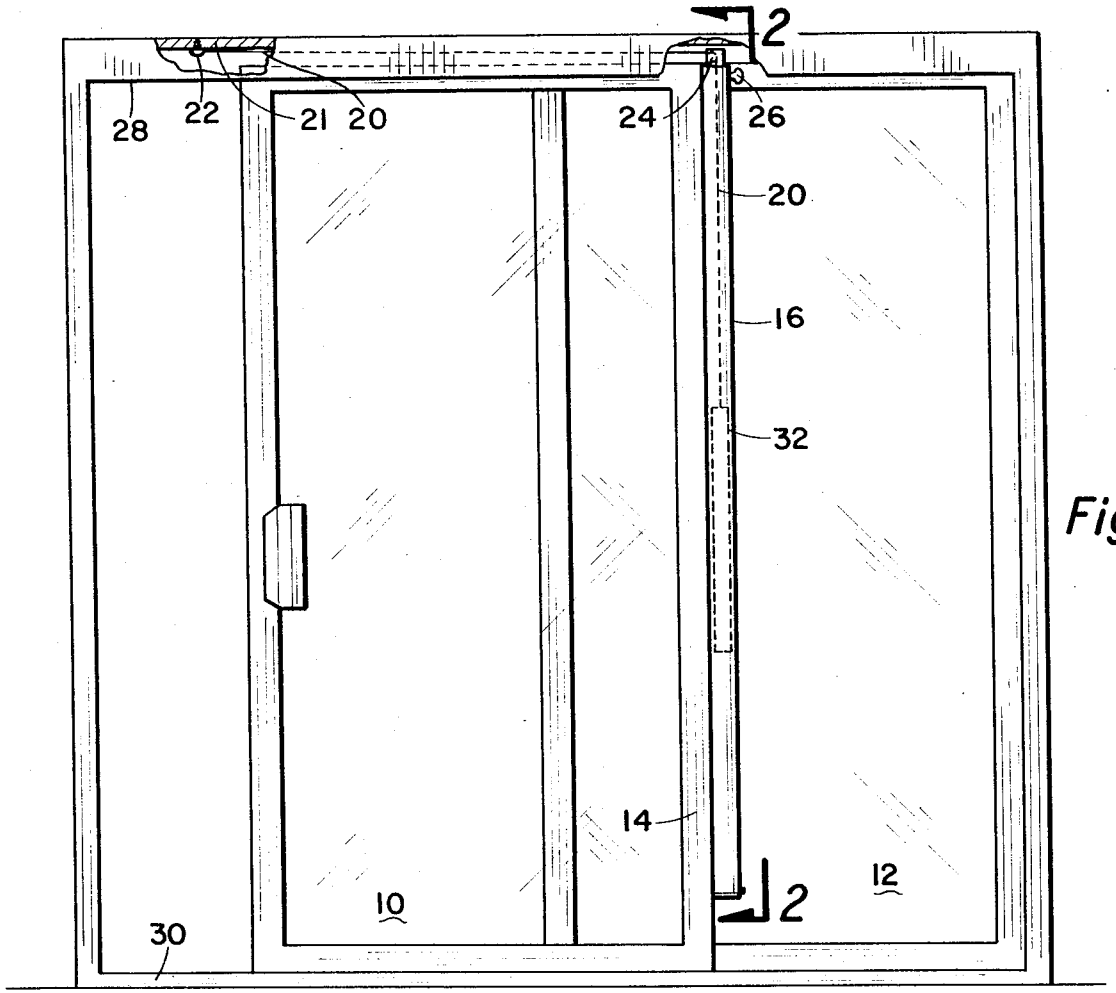
FIG. 1 illustrates a sliding glass door partially open with our invention attached thereto.

Attention is first directed to FIG. 1 which shows a glass door having a sliding panel 10 and a fixed panel 12. The sliding panel 10 is slidable along a lower track 30 and an upper track 28. Our automatic door closer indicated by housing 16 which is attached to back frame 14 of the sliding panel 10. It can be mounted thereto with a good quality double faced commercially available taping. A weight 32 is held in housing 16 by cable 20 which extends over pulley 24 to a cable anchor 22 which may be a screw secured to the door jam 21. A cable lock 26 is provided so that it can tighten on the cable and maintain the door in any degree of openess desired.

Figure 2:
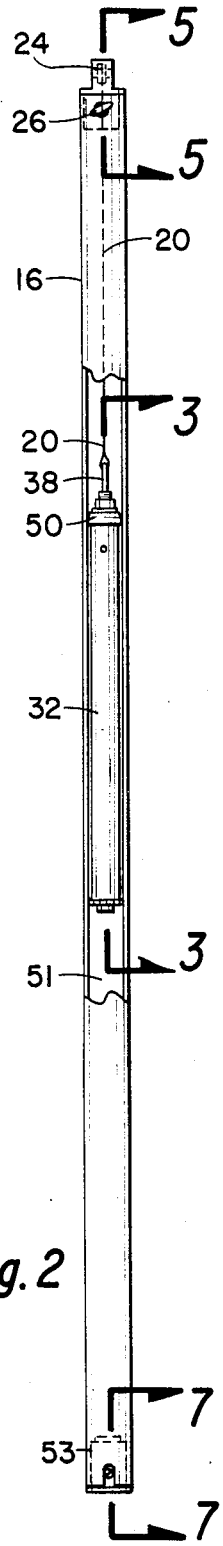
FIG. 2 is a schematic view taken along the line 2—2 of FIG. 1.

Attention is next directed to FIG. 2. Shown thereon is a weight 32 held by cable 20 which extends over pulley 24 at the top. A cable lock 26 is also shown. Weight 32 is shown provided with a seal 50 and valve stem 38 is attached to cable 20. The lower end of the housing below seal 50 forms a pneumatic cylinder 51 and air floor mechanism 53 is provided at the lower end of housing 16 so as to permit air to go in or out and for further providing means for controlling the restrictions within the passages as will become evident with the description of FIGS. 7 and 8 to follow.

Figure 3:
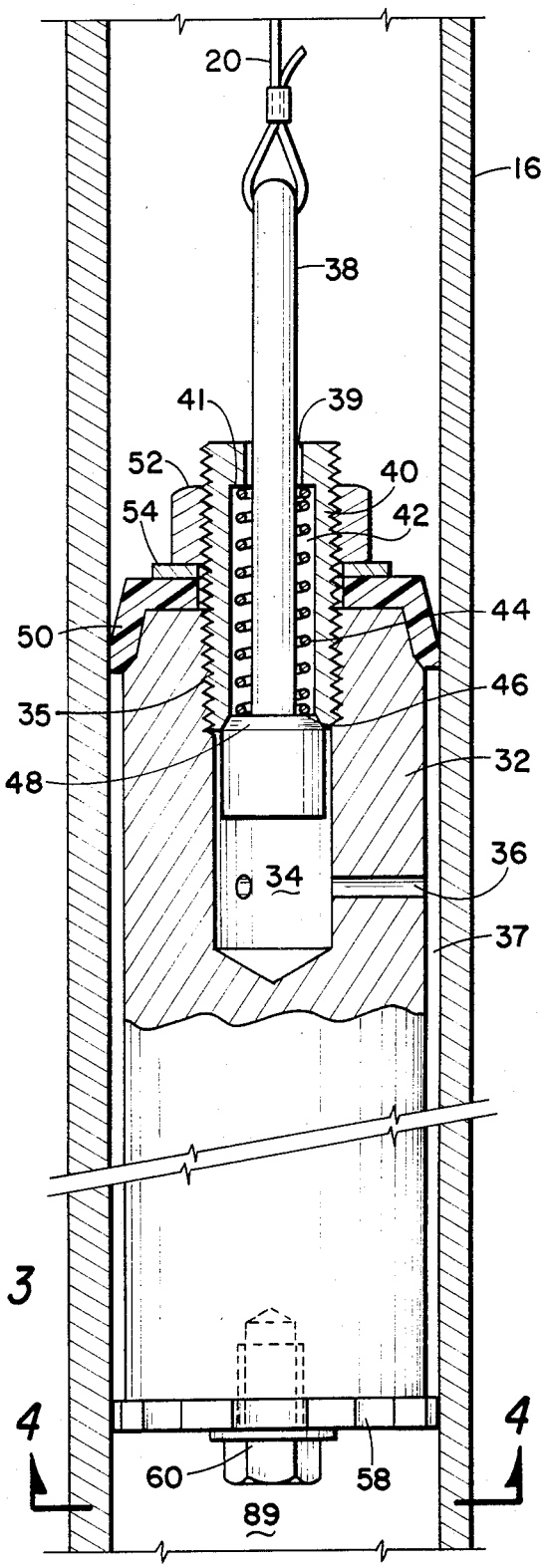
FIG. 3 is a view taken along the line 3—3 of FIG. 2.

Attention is next directed to FIG. 3 which shows the modifications of the weight 32 to make it a pneumatic piston. A can be seen, weight 32 is provided with a lower bore 34 and an upper bore 35 with threads into which a threaded bushing 40 is screwed and which itself has a small upper bore 39 and a larger bore 42 forming a shoulder 41. A valve 48 is provided in lower bore 34 and is provided with a valve stem 38 which connects to cable 20. A valve seat 46 is provided on the lower end of threaded bushing 40. A spring 44 biases the valve 48 to an opened position. However, in the position shown in FIG. 3, the cable 20 holds the valve upwardly and keeps the spring 44 compressed. A seal 50 is provided at the upper end of the weight 32 and seals the exterior wall of the weight 32 with the interior wall of housing 16. Seal 50 is held in place by seal retainer 54 which is in turn held in place by retaining nut 52. It is noted that stem 38 is considerably smaller than small bore 39 so that there is an air escape space therebetween. The lower end of bore 34 is provided with a lateral passage 36 which communicates the bore 34 to the annulus 37 between the housing and the weight 32.

Figure 4:
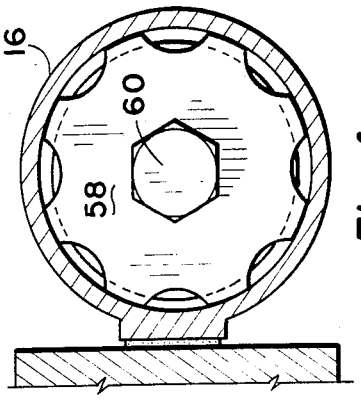
FIG. 4 is a view taken along the line 4—4 of FIG. 3.
Figure 9:
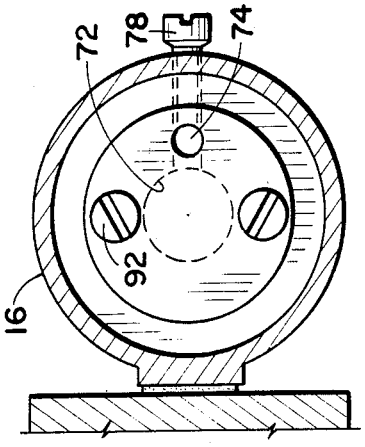
FIG. 9 is a view taken along the line 9—9 of FIG. 7.

As can be seen in FIG. 4, the lower end of weight 32 is provided with a centering device 58 which is held in position by nut or screw 60. The centralizer 58 is provided with scalloped edges so that air can readily enter into and flow from annulus 37.

Figure 8:
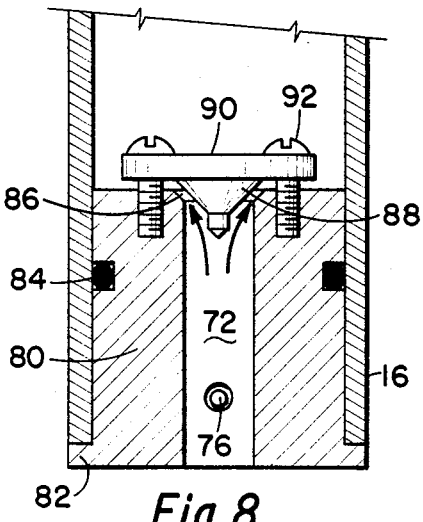
FIG. 8 is a view taken along the line 8—8 of FIG. 7.
Figure 7:
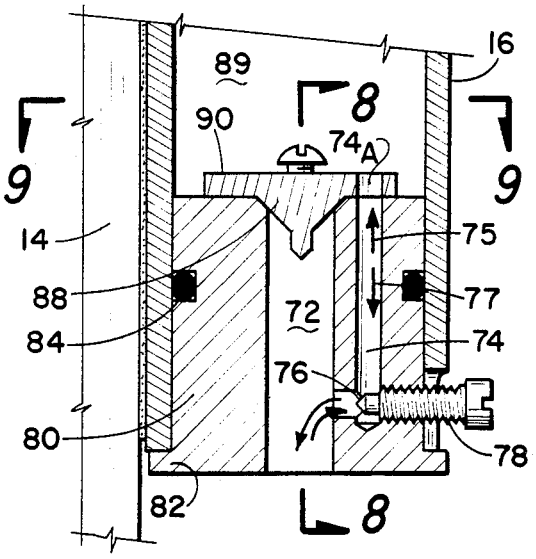
FIG. 7 is a view taken along the line 7—7 of FIG. 2.

Attention is next directed to FIGS. 7 and 8 to show the air control mechanism for the lower end of the housing 16 as indicated at 53 in FIG. 2. A plug 80 having a lip 82 and seals 84 is provided at the lower end of housing 16. Plug 80 has a central passage 72 and also a horizontal passage 76 and a vertical passage 74 which is in communication with the vertical central passage 76. A screw 78 having a restriction head can be adjusted to modify the restrictions in passage 74 and 76. The screw does not close this passage. Thus, this passage can at all times permit air to go in either direction as indicated by the arrows 75 and 77. A cap 90 is provided at the upper end of central passage 72 and is provided with a valve 88 which can set on seat 86 at the upper end of the passage 72. FIG. 7 shows the valve closed and FIG. 8 shows the valve opened. The valve in valve cap 90 is held in position by screws 92 which permits the valve to move up and down. A passage 74A is aligned with passage 74 so that the valve cap 90 will not restrict flow. Means are provided to maintain the cap 90 in the proper aligned position which is accomplished by the three bolts 92. When the piston or weight 32 is moving upwardly, that is when the door is being opened, then the valve 88 is opened to permit the air to rush in rapidly so that the door can be opened rather quickly. However, when the door is to be closed, one does not want the door to be closed in an uncontrolled position, therefore, the valve 88 is closed as shown in FIG. 7 and air can only escape from pneumatic cylinder 89 downwardly through ports 74A, 74 and 76 and central passage 72 in the normal operation when the door is closing by itself. If I wish the door to close more slowly, I can adjust the restriction by adjusting screw 78.

Figure 11:
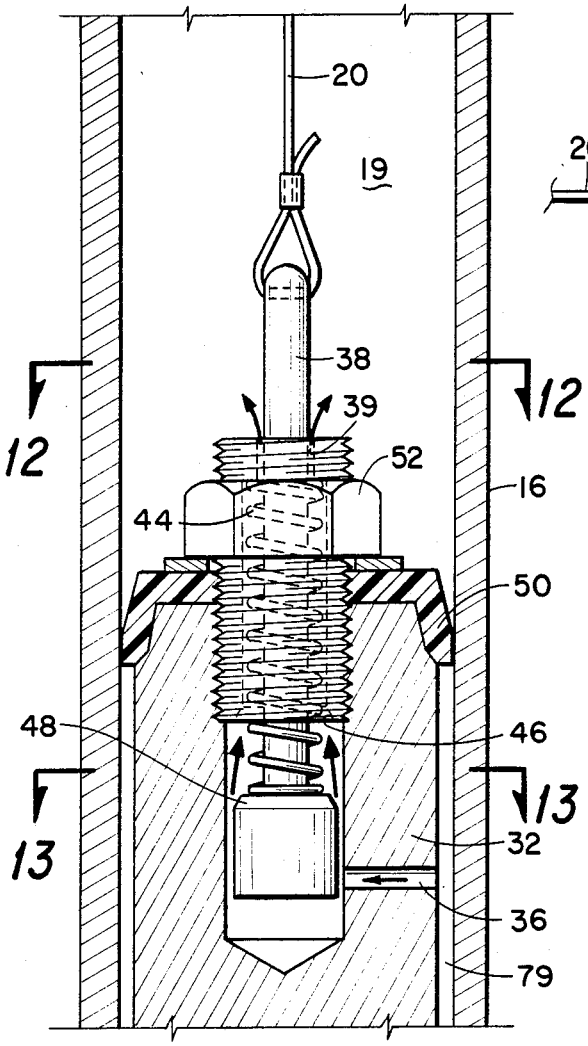
FIG. 11 is an enlarged view of the valve mechanism of FIG. 3 showing an open position.

FIG. 3 shows valve 48 in a closed position. However, if one manually forces the door closed in a rapid motion, then there will be slack in the cable 20 and it will cause the valve 48 to open as illustrated in FIG. 11. Then, the air can escape from pneumatic cylinder 89 below the weight up through annulus 79 passage 39, up around spring 44 and through the bore 39 as indicated by the arrows. The spring 44 has urged the valve 48 open. However, as soon as the weight is dropped enough to take the slack out of cable 20, the cable will pull the valve 48 up into the closed position as shown in FIG. 3. The door will then close in its normal speed as may be determined or controlled by the air flow control through passages 76 and 74 in the lower end of the housing. All that the valve mechanism in the upper end of weight 32 is required to do is to either be completely closed permitting no air to escape when the cable 20 is in a taught condition and to be open permitting air to escape when the cable 20 is in a relaxed or loose position. This is very simple.

Figure 6:
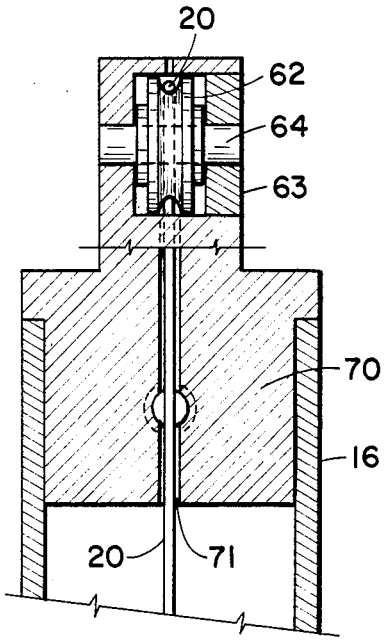
FIG. 6 is a view taken along the line 6—6 of FIG. 5.
Figure 5:
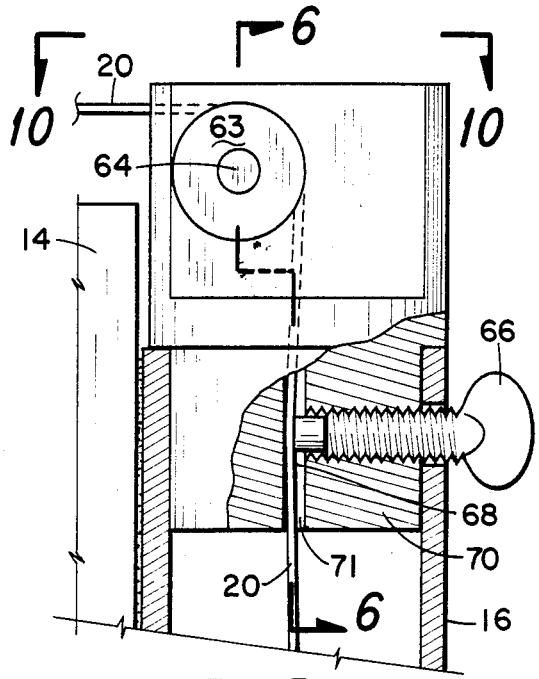
FIG. 5 is a view taken along the line 5—5 of FIG. 2.
Figure 10:
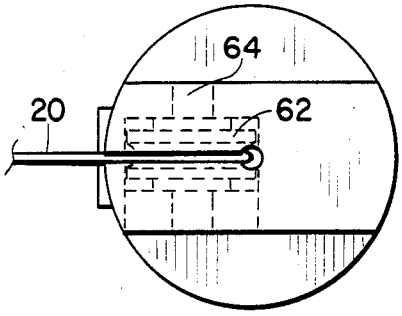
FIG. 10 is a view taken along the line 10—10 of FIG. 5.
Figure 12:
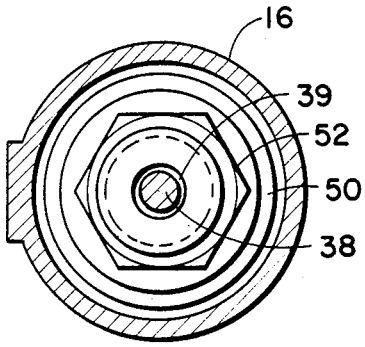
FIG. 12 is a view taken along the line 12—12 of FIG. 11.
Figure 13:
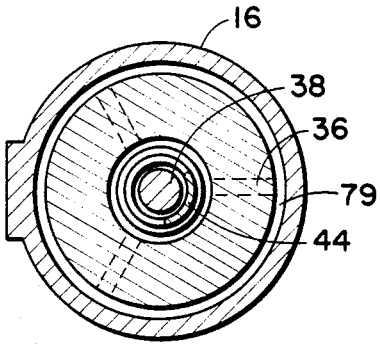
FIG. 13 is a view taken along the line 13—13 of FIG. 11.

Attention is next specifically directed to FIGS. 5, 6 and 10 to show means for maintaining cable 20 on pulley 62. The upper end of housing 16 is provided with a cap 70 having a vertical passage 71 through which the cable 16 extends up over pulley 62 and out through an opening in the side of the cap. Pulley 62 is mounted in a cavity in the upper end of cap 70 and after the pulley 62 has been put in that cavity, the closing plate 63 fits over axis 64. A screw 66 is provided for holding the cable in the event one wishes to have the door at an open or partially open position. When the door is manually moved to the desired position, screw 66 is then tightened against diaphragm 68 which holds the cable 20 secure. Cap 70 is preferably made of some plastic material such as polyurethane.

Air can escape from space 19 above seal 50 in housing 16 through the openings in cap 70 through which the cable 20 moves. If desired, a part could be provided in the upper end of housing 16.

While this invention has been described with a certain degree of particularity, it is manifest than many changes may be made in the details of construction in the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed is:

1. An energy saver door closer comprising:

an elongated housing;

a weight having a bore extending from the top of the weight and a passage from the lower end of said bore to the exterior thereof;

a valve seat in said bore above said passage;

sealing means for sealing the interior of said housing and the exterior of said weight above said passage;

a valve means for completely closing the upper end of said bore;

biasing means urging said valve means to an open position;

a cable connected to said valve means and extending upwardly therefrom;

port means in the lower end of said housing permitting air to flow in or out of said housing below said weight.

2. An energy saving door closer as defined in claim 1 including:

adjustable restriction means in said port means for varying the resistance of the flow of air through said port means.

3. An energy saver door closer as defined in claim 2 including:

a plug in the upper end of said housing with a vertical bore opening into a cavity in the upper portion thereof;

a cable pulley in said cavity and a cable opening from said cavity to the exterior of said plug so that a cable can extend upwardly through said vertical passage over said cable pulley and out said cable opening.

4. A energy saver door closer as defined in claim 3 including:

a screw threadably inserted through the wall of said housing and through a passage in said upper cap to secure said cable.

* * * * *